US012442155B2

(12) United States Patent
Tsukada et al.

(10) Patent No.: US 12,442,155 B2
(45) Date of Patent: Oct. 14, 2025

(54) WHEEL LOADER

(71) Applicant: Hitachi Construction Machinery Co., Ltd., Tokyo (JP)

(72) Inventors: Yoko Tsukada, Tokyo (JP); Hidekazu Moriki, Tsuchiura (JP); Yoshiaki Tsutsumi, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 186 days.

(21) Appl. No.: 18/023,431

(22) PCT Filed: Dec. 17, 2021

(86) PCT No.: PCT/JP2021/046800

§ 371 (c)(1),
(2) Date: Feb. 27, 2023

(87) PCT Pub. No.: WO2022/185669

PCT Pub. Date: Sep. 9, 2022

(65) Prior Publication Data

US 2023/0304254 A1 Sep. 28, 2023

(30) Foreign Application Priority Data

Mar. 1, 2021 (JP) ..... 2021-031953

(51) Int. Cl.
*E02F 3/43* (2006.01)
*E02F 3/28* (2006.01)
(Continued)

(52) U.S. Cl.
CPC ..... *E02F 3/43* (2013.01); *E02F 3/283* (2013.01); *E02F 3/422* (2013.01); *E02F 9/2271* (2013.01);
(Continued)

(58) Field of Classification Search
CPC ... E02F 3/43; E02F 3/283; E02F 3/422; E02F 9/2271; E02F 9/26; E02F 9/2228; E02F 9/2285
See application file for complete search history.

(56) References Cited

U.S. PATENT DOCUMENTS

2012/0191431 A1* 7/2012 Dunbabin ..... E02F 9/2029 703/6
2018/0135277 A1 5/2018 Tsuji
(Continued)

FOREIGN PATENT DOCUMENTS

DE 19858401 A1 * 6/2018 ..... B65G 67/04
JP 2007-297873 A 11/2007
(Continued)

OTHER PUBLICATIONS

Optimizing the trajectory of a wheel loader working in short loading cycles, Filla, ResearchGate Jun. 2013 (Year: 2013).*
(Continued)

*Primary Examiner* — Navid Z. Mehdizadeh
*Assistant Examiner* — Oliver Tan
(74) *Attorney, Agent, or Firm* — Crowell & Moring LLP

(57) ABSTRACT

Provided is a wheel loader capable of evenly loading a target object for loading onto a target area for loading with simple operation to thus mitigate a burden on an operator. The wheel loader 100 includes a travel device 120 that causes a vehicle body to travel, a drive device 150 that actuates a lift arm and a bucket, an area detection device 160 that detects a loading area, and a control device 170. The control device 170 recognizes the loading area on the basis of a detection result of the area detection device 160 and controls the travel device 120 and the drive device 150, so that the target object for loading contained in the bucket is distributed to be loaded in a plurality of different positions of the loading area
(Continued)

while changing the position of the vehicle body in the front-back direction.

5 Claims, 4 Drawing Sheets

(51) Int. Cl.
*E02F 3/42* (2006.01)
*E02F 9/22* (2006.01)
*E02F 9/26* (2006.01)

(52) U.S. Cl.
CPC ..... *E02F 9/26* (2013.01); *E02F 9/2228* (2013.01); *E02F 9/2285* (2013.01)

(56) References Cited

U.S. PATENT DOCUMENTS

2018/0171582 A1* 6/2018 Yamada ..... E02F 9/2246
2018/0239849 A1* 8/2018 Martinsson ..... E02F 3/40
2021/0010225 A1 1/2021 Seki et al.
2021/0040711 A1 2/2021 Seki et al.
2021/0165414 A1* 6/2021 Aizawa ..... E02F 3/437

FOREIGN PATENT DOCUMENTS

JP 2017-43887 A 3/2017
JP 2019-190237 A 10/2019
JP 2019-190238 A 10/2019

OTHER PUBLICATIONS

DE19858401A1 machine translation.*
International Search Report (PCT/ISA/210) issued in PCT Application No. PCT/JP2021/046800 dated Feb. 15, 2022 with English translation (four (4) pages).
Japanese-language Written Opinion (PCT/ISA/237) issued in PCT Application No. PCT/JP2021/046800 dated Feb. 15, 2022 (three (3) pages).

* cited by examiner

WHEEL LOADER

TECHNICAL FIELD

The present disclosure relates to a wheel loader.

BACKGROUND ART

An invention related to a control system of a work vehicle has conventionally been known (JP 2017-043887 A). A control system of a work vehicle described in JP 2017-043887 A includes a position determination section, a display section, and a representation control section (Abstract, claim 1, and paragraph 0009 of JP 2017-043887 A). The position determination section determines a loading position relative to a target vehicle for loading on the basis of the loading condition of the target vehicle for loading. The representation control section displays, on the display section, a loading guidance corresponding to the loading position determined by the position determination section for the target vehicle for loading that is laterally viewed.

More specifically, the position calculation section calculates a position in a target area for loading of the target vehicle for loading to be displayed on the display section, on the basis of the target vehicle for loading that is extracted by an image analysis section. Then, the position calculation section calculates, as a loading position, a predetermined position divided into three in a length direction of the extracted target area for loading, which corresponds to the position determined by the position determination section (paragraph 0088 of JP 2017-043887 A). The representation control section displays, on the display section, the loading guidance corresponding to the loading position determined by the position determination section on the basis of the loading position calculated by the position calculation section for the laterally viewed target vehicle for loading (paragraph 0091 of JP 2017-043887 A).

In this manner, the operator can perform the work of loading a target object for loading in the determined position of the laterally viewed target vehicle for loading by operating an operation portion while viewing the loading guidance displayed on the display section. In this case, the operator checks the loading guidance displayed on the display section for the laterally viewed target vehicle for loading and thus, can perform intuitive loading work (paragraph 0095 of JP 2017-043887 A).

CITATION LIST

Patent Literature

Patent Literature 1: JP 2017-043887 A

SUMMARY OF INVENTION

Technical Problem

In the above-described conventional control system, as described above, a loading guidance corresponding to predetermined loading positions divided in a length direction of a target area for loading is displayed on the display section for the laterally viewed target vehicle for loading. However, in order to evenly load a target object for loading in the loading positions displayed on the display section, the operator still needs to load the target object for loading in the loading positions multiple separate times by manually operating the work vehicle. Such manual operation of the work vehicle is complicated and requires expertise and imposes a significant burden on the operator.

The present disclosure provides a wheel loader capable of evenly loading a target object for loading onto a loading area to thus mitigate the burden on the operator.

Solution to Problem

An aspect of the present disclosure is a wheel loader including a vehicle body, a lift arm provided in the vehicle body so as to be vertically rotatable, a bucket provided on a tip end side of the lift arm so as to be able to perform dumping or tilting operation, a drive unit that is provided in the vehicle body and that drives wheels, a hydraulic actuator including a lift arm cylinder that actuates the lift arm and a bucket cylinder that actuates the bucket, a pressure sensor that detects a pressure of the hydraulic actuator, a posture sensor that detects a posture of the bucket, an external environment recognition sensor that recognizes a target vehicle for loading, and a controller that controls the hydraulic actuator and the drive unit, in which the controller includes a load computing section that computes a load of a target object loaded in the bucket, on the basis of the pressure detected by the pressure sensor, a loading platform recognition section that recognizes a loading platform of the target vehicle for loading that is detected by the external environment recognition sensor, a loading position computing section that computes loading sections such that the target object loaded in the bucket is evenly loaded onto the loading platform by sectioning, into a plurality of sections, the loading platform of the target vehicle for loading that is recognized by the loading platform recognition section, a bucket control section that controls a loading quantity for each of the sections on the basis of the load of the target object computed by the load computing section and the sections of the loading platform computed by the loading position computing section, and a travel control section that controls a moving amount of the vehicle body by controlling the drive unit such that the target object is divided to be loaded onto each of the sections on the basis of the load of the target object computed by the load computing section and the sections of the loading platform computed by the loading position computing section.

Advantageous Effects of Invention

According to the present disclosure, a wheel loader can be provided that is capable of evenly loading a target object for loading onto a loading area to thus mitigate the burden on the operator.

DESCRIPTION OF EMBODIMENTS

Hereinafter, an embodiment of a wheel loader according to the present disclosure will be described with reference to the drawings.

Embodiment 1

Figure 1:
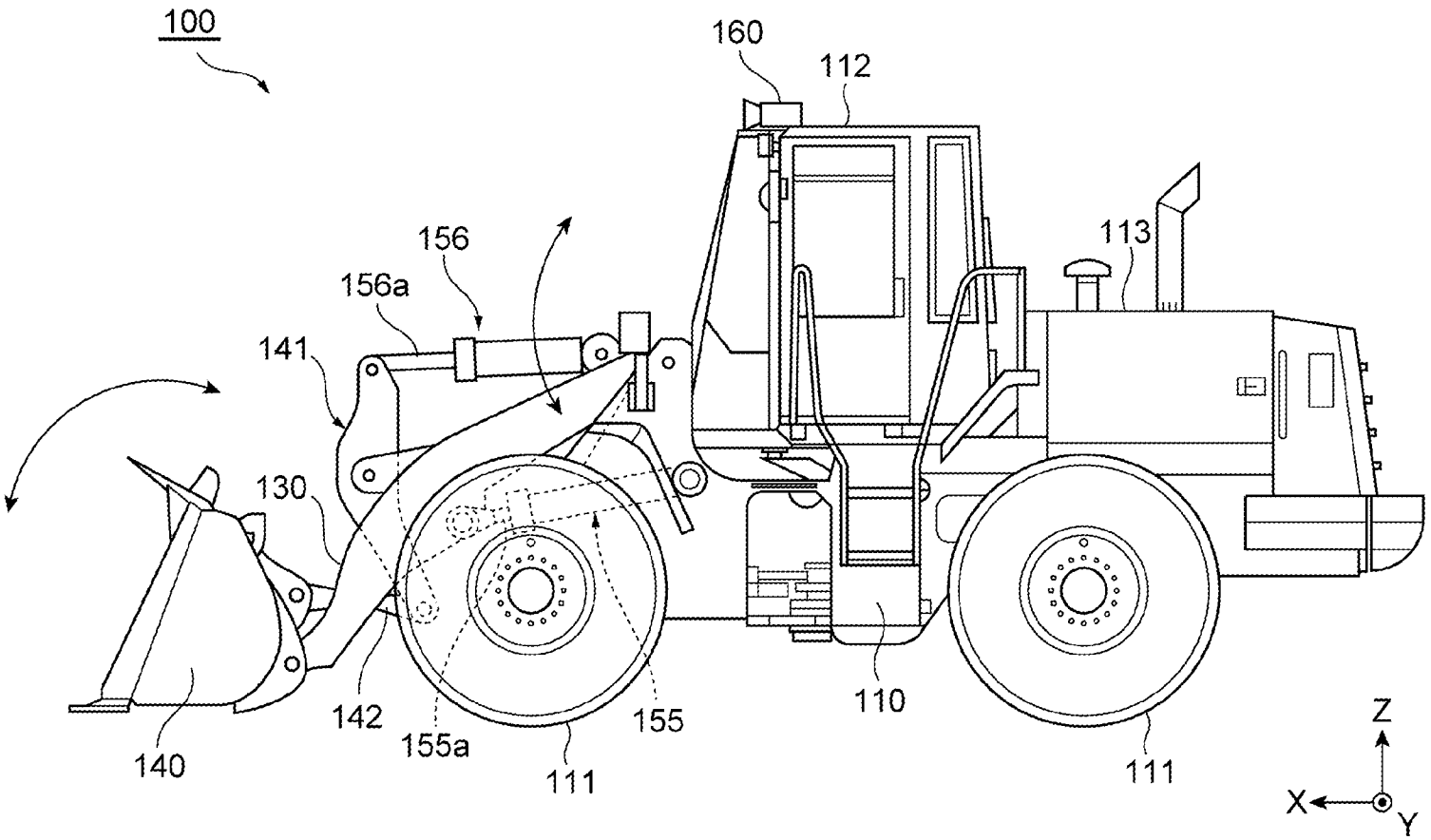
FIG. 1 is a side view showing an embodiment 1 of a wheel loader according to the present disclosure.
Figure 2:
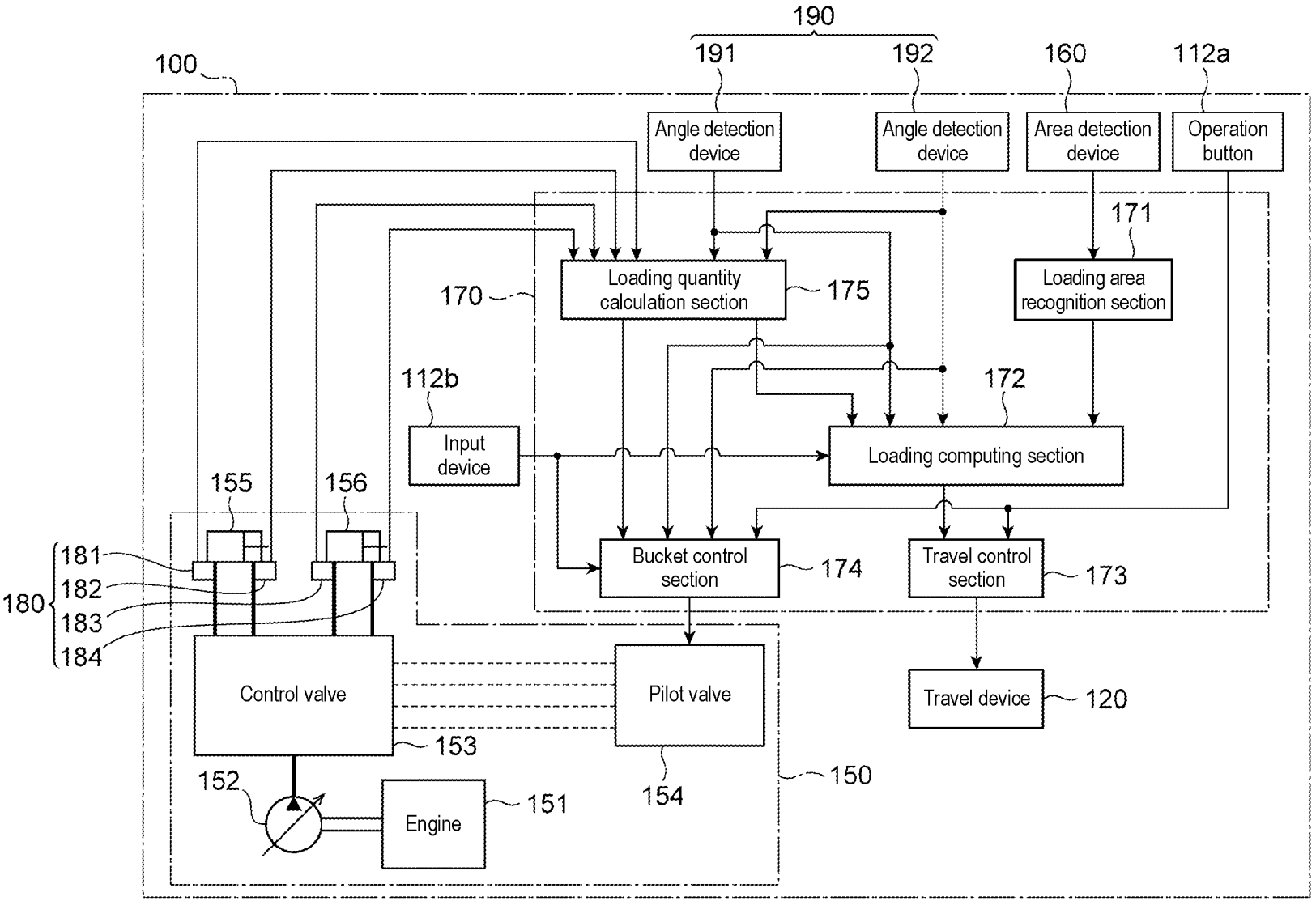
FIG. 2 is a block diagram of the wheel loader of FIG. 1.

FIG. 1 is a side view showing an embodiment 1 of a wheel loader according to the present disclosure. FIG. 2 is a block diagram of a wheel loader 100 shown in FIG. 1.

The wheel loader 100 is, for example, a work vehicle for loading a target object for loading, such as soil, sand, crushed rock, minerals, and the like, onto a loading area, such as a loading platform of a dump truck. In the following description, in some cases, portions of the wheel loader 100 are described on the basis of an orthogonal coordinate system of X-, Y-, and Z-axes as shown in FIG. 1, the X-axis being in parallel to the front-back direction of the wheel loader 100, the Y-axis being in parallel to the width direction of the wheel loader 100, the Z-axis being in parallel to the height direction of the wheel loader 100.

The wheel loader 100 includes, for example, a vehicle body 110, a travel device 120, a lift arm 130, a bucket 140, a drive device 150, an area detection device 160, and a control device 170. The wheel loader 100 further includes, for example, a loading quantity detection device 180. The wheel loader 100 further includes, for example, a posture detection device 190. The wheel loader 100 further includes, for example, a position detection device (not shown), such as a receiver of the Global Navigation Satellite System (GNSS).

The vehicle body 110 is configured, for example, such that a front body in a front portion and a rear body in a rear portion are coupled together. The vehicle body 110 includes, for example, wheels 111, an operating room 112 where an operator is on board, and an engine room 113. The wheels 111 include a pair of front wheels attached to the front body of the vehicle body 110 and a pair of rear wheels attached to the rear body of the vehicle body 110, and are driven by the travel device 120 to cause the vehicle body 110 to travel. The operating room 112 is provided in an upper middle portion of the vehicle body 110. The engine room 113 is, for example, disposed in the rear of the operating room 112 and houses the travel device 120 and the drive device 150 including an engine 151 that are shown in FIG. 2.

Inside the operating room 112, for example, an operation button 112*a* and an input device 112*b* that are shown in FIG. 2, an operation lever, an accelerator pedal, a brake pedal, a steering wheel, a meter, a display device, a speaker, a display lamp, and the like (which are not shown) are disposed. The operation button 112*a* is, for example, pressed by an operator when the control device 170 starts a semi-automatic loading control of the wheel loader 100. The input device 112*b*, for example, accepts an input of the number of divisions of a loading area from the operator when the semi-automatic loading control of the wheel loader 100 is performed by the control device 170.

The travel device 120 is, for example, connected to the control device 170 so as to be able to communicate information therebetween. The travel device 120 drives the wheels 111 by transmitting power of the engine 151, via a hydraulic transmission (HST), for example, on the basis of a control signal output from the control device 170 so as to cause the vehicle body 110 to travel. The travel device 120 may include, for example, a drive unit using a torque convertor. Further, the travel device 120 causes the wheel loader 100 to automatically travel along a predetermined traveling route, by controlling an accelerator, a brake, a steering, and the like of the wheel loader 100.

A pair of lift arms 130 are coupled to both left and right sides of an upper portion of the front body of the vehicle body 110 so as to be vertically rotatable via a rotation shaft. A bellcrank 141 is provided between the pair of lift arms 130. The bellcrank 141 is coupled to a support portion extending forward from a coupling portion that couples the pair of lift arms 130, via the rotation shaft in a swingable manner. An end of the bellcrank 141 is coupled to a base end portion of a bucket link 142 via the rotation shaft.

The bucket 140 is coupled to distal end portions on the opposite side of base end portions of the pair of lift arms 130, the base end portions being coupled to the vehicle body 110, so as to be vertically rotatable via the rotation shaft. A distal end portion of the bucket link 142 is coupled to an outer side of a bottom portion of the bucket 140 via the rotation shaft. The drive device 150 includes, for example, the engine 151, a hydraulic pump 152, a control valve 153, a pilot valve 154, a lift arm cylinder 155, and a bucket cylinder 156, and actuates the lift arm 130 and the bucket 140. Note that in FIG. 2, a thin solid line indicates an electric signal, a thick solid line indicates a hydraulic pressure, and a thin dashed line indicates a pilot pressure.

The engine 151 drives the hydraulic pump 152. The hydraulic pump 152 is driven by the engine 151 to deliver an operating oil so as to supply a hydraulic pressure to the control valve 153. The control valve 153 supplies the hydraulic pressure supplied from the hydraulic pump 152 to a bottom room or a rod room of the lift arm cylinder 155 and the bucket cylinder 156 in accordance with a pilot pressure supplied from the pilot valve 154. The pilot valve 154 controls the pilot pressure to be supplied to the control valve 153 in accordance with a control signal output from the control device 170.

A pair of lift arm cylinders 155 each include a rod 155*a* coupled, via the rotation shaft, to a lower portion of a middle portion in the longitudinal direction of each of the pair of lift arms 130. An end portion on the opposite side of the rod 155*a* of each of the pair of lift arm cylinders 155 is coupled to the front body of the vehicle body 110 via the rotation shaft. The bucket cylinder 156 is disposed between the pair of lift arms 130 and includes a rod 156*a* coupled, via the rotation shaft, to an end portion of the bellcrank 141, which is on the opposite side of the end portion to which the bucket link 142 is coupled.

With such a configuration, when the operating oil is supplied from the hydraulic pump 152, via the control valve 153, to the bottom room of each of the pair of lift arm cylinders 155, the rod 155*a* of each of the pair of lift arm cylinders 155 extends. In this manner, the pair of lift arms 130 rotate upward about the rotation shaft supported in the front body of the vehicle body 110.

Further, when the operating oil is supplied from the hydraulic pump 152, via the control valve 153, to the rod room of each of the pair of lift arm cylinders 155, the rod 155*a* of each of the pair of lift arm cylinders 155 retracts. In this manner, the pair of lift arms 130 rotate downward about the rotation shaft supported in the front body of the vehicle body 110.

Furthermore, when the operating oil is supplied from the hydraulic pump 152, via the control valve 153, to the bottom room of the bucket cylinder 156, the rod 156*a* of the bucket cylinder 156 extends. In this manner, the bellcrank 141 swings to thus transmit power via the bucket link 142, so that the bucket 140 rotates upward about the rotation shaft supported in the distal end portion of the lift arm 130.

Moreover, when the operating oil is supplied from the hydraulic pump 152, via the control valve 153, to the rod room of the bucket cylinder 156, the rod 156*a* of the bucket cylinder 156 retracts. In this manner, the bellcrank 141 swings to thus transmit power via the bucket link 142, so that the bucket 140 rotates downward about the rotation shaft supported in the distal end portion of the lift arm 130.

The area detection device 160 is, for example, a device that detects a loading area such as a loading platform of a dump truck. The area detection device 160 may be configured with, for example, an image capturing device, such as a monocular camera and a stereo camera, or a LiDAR (laser radar). The area detection device 160 detects, for example, the shape, the size, and the relative position with respect to the wheel loader 100 of the loading area.

In the wheel loader 100 of the present embodiment, the area detection device 160 is attached to, for example, an upper portion of the operating room 112 provided in the vehicle body 110. More specifically, the area detection device 160 is attached to, for example, the upper portion of the operating room 112 so as to face ahead of the wheel loader 100.

The control device 170 is, for example, disposed inside or near the operating room 112 and connected to the travel device 120, the drive device 150, and the area detection device 160. The control device 170 is configured with, for example, an electric control device including a processor such as a CPU, a memory, a timer, an input/output section, and the like.

As shown in FIG. 2, for example, the control device 170 includes a loading area recognition section 171, a loading computing section 172, a travel control section 173, and a bucket control section 174. Further, the control device 170 includes, for example, a loading quantity calculation section 175. These sections of the control device 170 indicate various functions of the control device 170 embodied by, for example, the processor of the control device 170 executing programs loaded in a memory of the control device 170. The operation of the control device 170 will be described later.

The loading quantity detection device 180 is a device that detects the quantity of a target object for loading contained in the bucket 140. The loading quantity detection device 180 includes, for example, a pressure sensor 181 that measures the pressure of the operating oil in the bottom room of the lift arm cylinder 155, and a pressure sensor 182 that measures the pressure of the operating oil in the rod room of the lift arm cylinder 155. The pressure sensors 181, 182 output signals corresponding to the pressure of the operating oil that varies depending on the quantity of the target object for loading contained in the bucket 140.

Further, the loading quantity detection device 180 includes, for example, a pressure sensor 183 that measures the pressure of the operating oil in the bottom room of the bucket cylinder 156, and a pressure sensor 184 that measures the pressure of the operating oil in the rod room of the bucket cylinder 156. The pressure sensors 183, 184 output signals corresponding to the pressure of the operating oil that varies depending on the quantity of the target object for loading contained in the bucket 140.

The posture detection device 190 is a device that detects a posture of the bucket 140. The posture detection device 190 includes, for example, an angle sensor 191 that detects an angle of the lift arm 130 relative to the vehicle body 110, and an angle sensor 192 that detects an angle of the bellcrank 141 relative to the lift arm 130. The angle sensors 191, 192 detect the angle of the lift arm 130 relative to the vehicle body 110 and the angle of the bellcrank 141 relative to the lift arm 130 and output signals corresponding to the detected angles, as the posture of the bucket 140.

Figure 3:
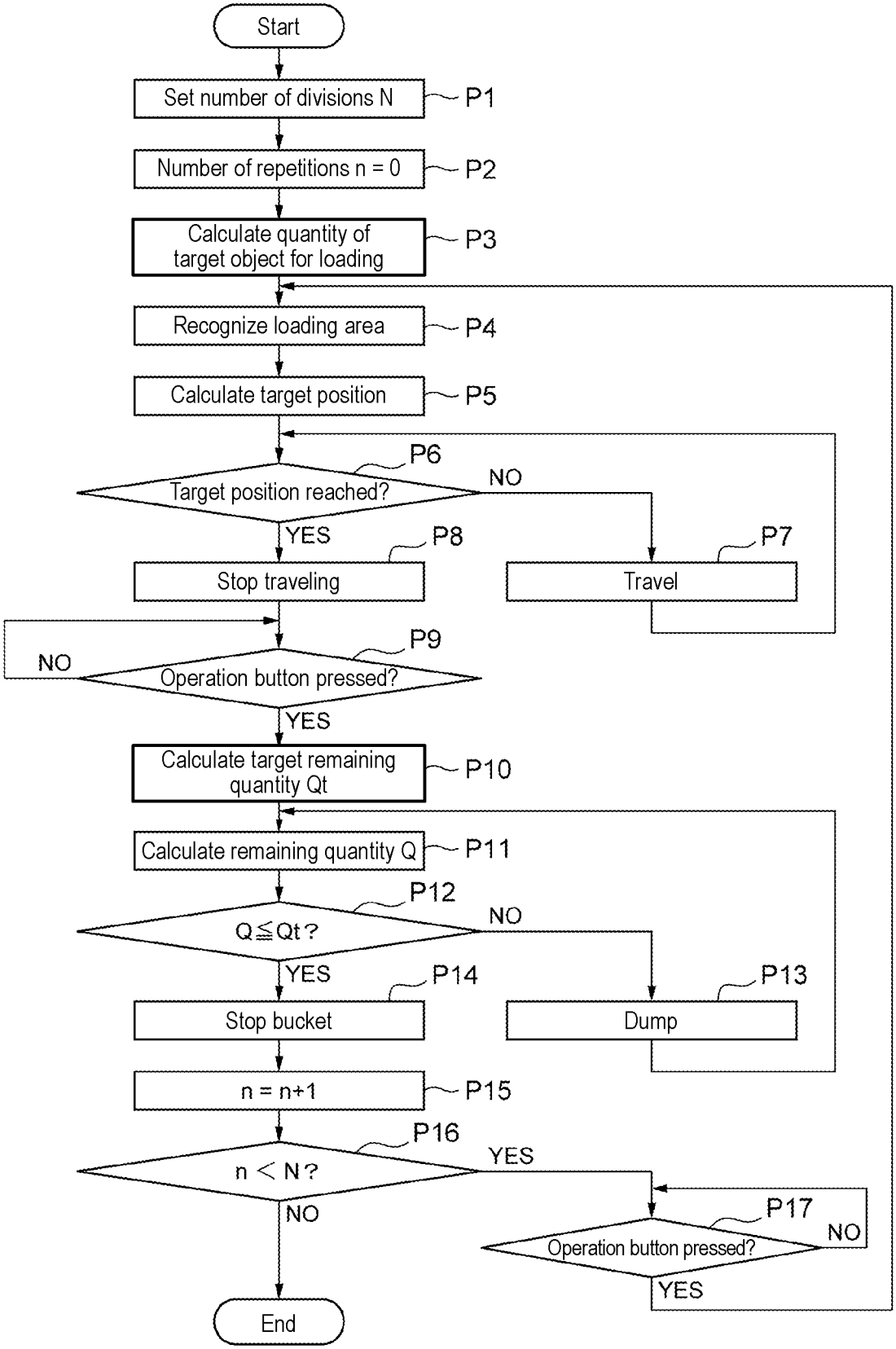
FIG. 3 is a flowchart showing an example of operation of the wheel loader of FIG. 1.
Figure 4:
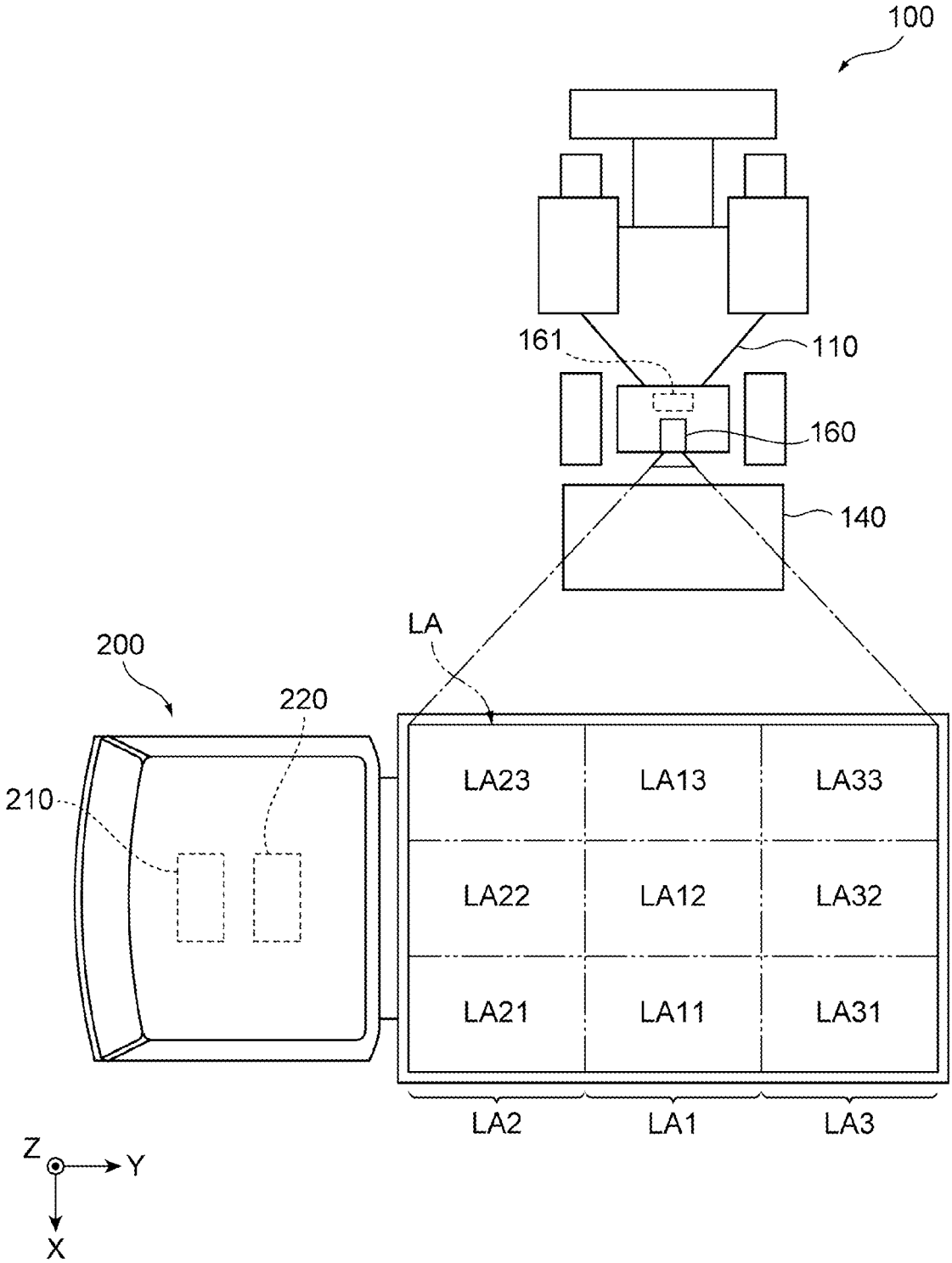
FIG. 4 is a schematic plan view of the wheel loader of FIG. 1 and a dump truck.

Hereinafter, an example of the operation of the wheel loader 100 including the operation of the above-described control device 170 will be described. FIG. 3 is a flowchart showing an example of the operation of the wheel loader 100. FIG. 4 is a schematic plan view of the wheel loader 100 and a dump truck 200.

Prior to starting a series of processing shown in FIG. 3, for example, the operator of the wheel loader 100 scoops a target object for loading, such as soil, sand, crushed rock, and minerals, by means of the bucket 140. Specifically, for example, the operator manually operates the operation lever, the acceleration pedal, the brake pedal, and the like in the operating room 112 to cause the drive device 150 to actuate the lift arm 130 and the bucket 140 to thus scoop the target object for loading by means of the bucket 140.

Thereafter, for example, the operator manually operates the acceleration pedal, the steering wheel, the brake pedal, and the like in the operating room 112 to cause the wheel loader 100 to travel by means of the travel device 120. Then, as shown in FIG. 4, for example, the operator moves the wheel loader 100 to a position where a loading area LA can be detected by the area detection device 160. Here, the loading area LA is an area where the target object for loading is loaded by the wheel loader 100, and is a loading platform of the dump truck 200 as the target vehicle for loading in the example shown in FIG. 4.

Next, for example, the operator presses the operation button 112*a* in the operating room 112. In this manner, the control device 170 starts the semi-automatic loading control shown in FIG. 3. For example, the control device 170 executes processing P1 of setting the number of divisions N for distributing the target object for loading contained in the bucket 140 to a plurality of different positions to be loaded.

The number of divisions N set in the processing P1 is, for example, the number of divisions N of the loading area LA in the front-back direction (X-axis direction) of the vehicle body 110 of the wheel loader 100 shown in FIG. 4. For example, when the operator inputs "3" as the number of divisions N of the loading area LA to the input device 112*b* shown in FIG. 2, the information of the number of divisions N is input to the loading computing section 172 of the wheel loader 100.

Note that the number of divisions N of the loading area LA in the front-back direction of the vehicle body 110 of the wheel loader 100 may be, for example, any natural number equal to two or larger. Further, in the loading computing section 172, an upper limit and a lower limit for the number of divisions N of the loading area LA may be set. Furthermore, as will be described later, the number of divisions N of the loading area LA in the front-back direction of the vehicle body 110 may be automatically calculated by the loading computing section 172 without input from the input device 112*b*.

Next, for example, the control device 170 executes processing P2 of resetting the number of repetitions n of division and loading operation by means of the loading computing section 172. Here, the division and loading operation is an operation of loading a part of the target object for loading contained in the bucket 140 onto each of divided areas LA11, LA12, LA13 that are obtained by dividing the loading area LA by the predetermined number of divisions N in the front-back direction of the vehicle body 110 of the wheel loader 100. That is, when the number of repetitions n of the division and loading operation is equal to the number of divisions N of the loading area LA in the front-back direction of the vehicle body 110, the target object for loading contained in the bucket 140 is completely loaded onto the loading area LA.

Next, for example, the control device 170 executes processing P3 of calculating the quantity of the target object for loading contained in the bucket 140 by means of the loading quantity calculation section 175. More specifically, in the processing P3, for example, the loading quantity calculation section 175 calculates the weight of the target object for loading contained in the bucket 140. In the processing P3, for example, the loading quantity calculation section 175 acquires the angle of the lift arm 130 relative to the vehicle body 110 and the angle of the bellcrank 141 relative to the lift arm 130 from the angle sensors 191, 192 as the posture detection device 190. Then, for example, the loading quantity calculation section 175 calculates the postures of the lift arm 130 and the bucket 140 by inputting the acquired angles into a formula stored in advance in a memory device.

Further, in the processing P3, for example, the loading quantity calculation section 175 acquires the pressures of the operating oil in the bottom room and the rod room of the lift arm cylinder 155 from the pressure sensors 181, 182 as the loading quantity detection device 180. Then, the loading quantity calculation section 175 calculates the weight of the target object for loading contained in the bucket 140 on the basis of the calculated postures of the lift arm 130 and the bucket 140 and the pressures acquired from the pressure sensors 181, 182. Furthermore, in a case where the pressure sensors 183, 184 are provided in the bottom room and the rod room of the bucket cylinder 156, the loading quantity calculation section 175 may further calculate the weight of the target object for loading contained in the bucket 140 using the pressures in the bottom room and the rod room of the bucket cylinder 156.

Note that the quantity of the target object for loading that is calculated by the loading quantity calculation section 175 is not limited to the weight. For example, the loading quantity calculation section 175 may calculate the volume of the target object for loading on the basis of the density of the target object for loading that is stored in advance in the memory device, in addition to the postures and the pressures acquired from the posture detection device 190 and the loading quantity detection device 180. Further, for example, the loading quantity calculation section 175 may calculate the volume of the target object for loading on the basis of the capacity of the bucket 140. Furthermore, for example, the loading quantity calculation section 175 may calculate the quantity of the target object for loading contained in the bucket 140 on the basis of an image from an image capturing device as the area detection device 160.

Next, for example, the control device 170 executes processing P4 of recognizing the loading area LA by means of the loading area recognition section 171. As shown in FIG. 4, for example, the loading area recognition section 171 recognizes the loading area LA by calculating the shape, the size, the capacity, and the position relative to the wheel loader 100 of the loading area LA on the basis of the detection result of the area detection device 160 including the image capturing device or the laser radar.

Then, for example, the control device 170 executes processing P5 of computing a target position of the wheel loader 100. In the example shown in FIG. 4, the loading area LA is a rectangular area, for example. Further, for example, in the wheel loader 100, a front end of the bucket 140 opposes a middle portion in the longitudinal direction of the loading area LA, with the width direction of the vehicle body 110 substantially parallel to the longitudinal direction of the loading area LA and with the front-back direction of the vehicle body 110 substantially parallel to the lateral direction of the loading area LA.

In this case, for example, the control device 170 calculates the target position for loading the target object for loading onto a first loading row LA1 of the loading area LA, the first loading row LA1 being a portion opposing the bucket 140 in the front-back direction (X-axis direction) of the vehicle body 110 of the wheel loader 100. More specifically, for example, the control device 170 calculates, by means of the loading computing section 172, the divided areas LA11, LA12, LA13 that are obtained by dividing the first loading row LA1 in the front-back direction of the vehicle body 110 by the number of divisions N set in the above-described processing P1.

Further, for example, the loading computing section 172 calculates a target position of the wheel loader 100 for loading the target object for loading onto each of the calculated divided areas LA11, LA12, LA13. Furthermore, for example, the loading computing section 172 calculates a traveling route of the wheel loader 100 from the current position of the wheel loader 100 to a target position where the target object for loading is loaded next.

Specifically, a moving amount of the vehicle body driven by the drive unit is controlled by associating it with each divided area LA11, LA12, LA13. For example, as shown in FIG. 4, when the loading area LA of the loading platform of the dump truck 200 is divided into three in the width direction of the dump truck 200, the length of each divided area LA11, LA12, LA13 in the width direction of the dump truck 200 is computed.

Further, the loading computing section 172 computes the position of the bucket 140 relative to the loading area LA from the postures of the lift arm 130 and the bucket 140 based on the information detected by the posture detection device 190 and the shape, the size, and the position of the loading area LA recognized by the loading area recognition section 171.

Next, as shown in FIG. 3, for example, the control device 170 executes processing P6 of determining whether the wheel loader 100 has reached the target position. For example, the control device 170 determines, by means of the travel control section 173, whether the current position of the wheel loader 100 and the target position are the same. For example, in the processing P6, when it is determined that the wheel loader 100 has not reached the target position (NO), the travel control section 173 executes processing P7 of controlling the travel device 120 to cause the wheel loader 100 to travel along the traveling route to the target position, and returns to the processing P6. Further, in the processing P7, the travel control section 173 controls the number of rotations of the drive unit of the travel device 120 so that the wheel loader 100 moves the length of each divided area LA11, LA12, LA13 in the width direction of the dump truck 200. For example, when loading onto the divided area LA11 ends, the control is performed such that the wheel loader 100 moves back by a distance corresponding to the length of the divided area LA11 in the width direction of the dump truck 200.

Further, for example, in the processing P6, when it is determined that the wheel loader 100 has reached the target position (YES), the travel control section 173 executes processing P8 of controlling the travel device 120 to cause the wheel loader 100 to stop traveling. Thereafter, for example, the control device 170 executes processing P9 of determining whether the operation button 112*a* has been pressed.

In the processing P9, for example, when it is determined, by the bucket control section 174, that the operator has not pressed the operation button 112*a* (NO), the control device 170 repeats the processing P9. Meanwhile, in the processing P9, for example, when it is determined, by the bucket control section 174, that the operator has pressed the operation button 112*a* (YES), the control device 170 executes processing P10 of calculating a target remaining quantity Qt of the target object for loading.

In the processing P10, for example, the control device 170 calculates the target remaining quantity Qt of the target object for loading by means of the bucket control section 174. Here, the target remaining quantity Qt is the quantity of the target object for loading that should remain in the bucket 140 after loading a part of the target object for loading contained in the bucket 140 onto the divided area LA11 where the target object for loading is loaded next. For example, the bucket control section 174 calculates a target remaining weight as the target remaining quantity Qt of the target object for loading after loading a part of the target object for loading onto the divided area LA11, on the basis of the current number of repetitions n, the number of divisions N set in the above-described processing P1, and the weight of the target object for loading calculated in the above-described processing P3.

More specifically, the bucket control section 174 calculates a divided loading quantity obtained by dividing the loading weight of the target object for loading calculated in the above-described processing P3 by the number of divisions N. Further, the bucket control section 174 calculates a weight obtained by subtracting, from the above loading weight, a weight obtained by multiplying the above divided loading quantity by the current number of repetitions n, as the target remaining quantity Qt of the target object for loading.

Next, for example, the control device 170 executes, by means of the loading quantity calculation section 175, processing of calculating a current remaining quantity Q of the target object for loading contained in the bucket 140. More specifically, for example, the loading quantity calculation section 175 calculates the weight of the target object for loading currently contained in the bucket 140, similarly to the above-described processing P3. Thereafter, the control device 170 executes processing P12 of determining whether the current remaining quantity Q is equal to or lower than the target remaining quantity Qt.

In the processing P12, for example, when it is determined, by the bucket control section 174, that the current remaining quantity Q of the target object for loading contained in the bucket 140 is greater than the target remaining quantity Qt (NO), the control device 170 executes processing P13 of dumping the target object for loading inside the bucket 140. In the processing P13, the bucket control section 174 outputs a control signal to the pilot valve 154 of the drive device 150 to increase the lift amount of the lift arm 130 and the tilt amount of the bucket 140.

In the processing P13, for example, the bucket control section 174 dumps a part of the target object for loading to one divided area LA11 so that the target object for loading inside the bucket 140 can be divided to be evenly loaded onto the plurality of divided areas LA11, LA12, LA13. Further, in the processing P13, the bucket control section 174 calculates the position of a claw tip of the bucket 140 on the basis of the output from the posture detection device 190 and outputs a control signal to the pilot valve 154 so that the position of the claw tip of the bucket 140 is at a predetermined height or higher for avoiding the contact with the loading area LA. Thereafter, the control device 170 executes the processing P11 again.

Meanwhile, in the processing P12, when it is determined that the current remaining quantity Q of the target object for loading contained in the bucket 140 is equal to or smaller than the target remaining quantity Qt (YES), the bucket control section 174 executes processing P14 of stopping the lift arm 130 and the bucket 140. In the processing P14, for example, the control device 170 controls, by means of the bucket control section 174, the drive device 150 to stop the lift arm 130 and the bucket 140.

Next, for example, the control device 170 executes, by means of the loading computing section 172, processing P15 of incrementing the number of repetitions n by adding 1 to the current number of repetitions n, and executes processing P16 of determining whether the number of repetitions n is smaller than the number of divisions N. In the processing P16, for example, when it is determined, by the loading computing section 172, that the number of repetitions n is smaller than the number of divisions N (YES), the control device 170 executes, by means of the travel control section 173, processing P17 of determining whether the operator has pressed the operation button 112*a*.

In the processing P17, when it is determined that the operator has not pressed the operation button 112*a* (NO), the travel control section 173 repeats the processing P17. Meanwhile, when it is determined that the operator has pressed the input device 112*b* (YES), the travel control section 173 repeats the above-described processing P4 to P6 and the target object for loading is loaded onto the next divided area LA12. In this manner, as shown in FIG. 4, the target object for loading contained in the bucket 140 is distributed in accordance with the number of divisions N to be evenly loaded onto the divided areas from LA11 positioned on the front side in the front-back direction of the wheel loader 100 to LA13 positioned on the rear side.

Further, in the front-back direction of the vehicle body 110 of the wheel loader 100, when loading of the target object for loading onto all the divided areas LA11, LA12, LA13 ends and the bucket 140 becomes empty, the number of repetitions n is equal to the number of divisions N. As a result, in the above-described processing P16, for example, the bucket control section 174 determines that the number of repetitions n is equal to or greater than the number of divisions N (NO), and the semi-automatic loading control shown in FIG. 3 ends.

In the above manner, the target object for loading contained in the bucket 140 is completely loaded onto the first loading row LA1 in the middle portion of the loading area LA shown in FIG. 4 in the width direction of the vehicle body 110 of the wheel loader 100. Then, in the first loading row LA1, the target object for loading is divided to be evenly loaded onto the plurality of divided areas LA11, LA12, LA13 that are divided in the front-back direction of the vehicle body 110.

Next, the operator manually operates to cause the wheel loader 100 to travel to thus move the wheel loader 100 to a location where the target object for loading is piled. Further, the operator manually operates the lift arm 130 and the bucket 140 to thus scoop the target object for loading by means of the bucket 140. Thereafter, the operator manually operates to cause the wheel loader 100 to travel, and to stop such that the front end portion of the bucket 140 opposes a second loading row LA2 of the loading area LA where the target object for loading is loaded next as shown in FIG. 4, and presses the operation button 112*a*.

Then, the control device 170 starts the semi-automatic loading control shown in FIG. 3, and the target object for loading contained in the bucket 140 is distributed to be evenly loaded onto divided areas LA21, LA22, LA23 of the second loading row LA2. Thereafter, the operator can distribute the target object for loading contained in the bucket 140 to be evenly loaded onto divided areas LA31, LA32, LA33 of a third loading row LA3 of the loading area LA by repeating the same procedures.

Hereinafter, the effects of the wheel loader 100 of the present embodiment will be described on the basis of the comparison with a control system of a conventional work vehicle. As described above, in the conventional control system described in JP 2017-043887 A, a loading guidance corresponding to predetermined loading positions divided in a length direction of a target area for loading is displayed on the display section for the laterally viewed target vehicle for loading. However, in order to evenly load the target object for loading in the loading positions displayed on the display section, the operator still needs to load the target object for loading in the loading positions multiple separate times in the front-back direction of the vehicle by manually operating the work vehicle.

Such manual operation of the work vehicle is complicated and requires expertise and imposes a significant burden on the operator. Further, for example, in the conventional control system, when the load on the loading platform of the target vehicle for loading is uneven in the front-back direction of the work vehicle, the operation performance such as stopping and steering of the target vehicle for loading could be adversely affected. In such a case, abrasion of tires and deterioration of fuel of the target vehicle for loading could further be triggered.

In contrast, the wheel loader 100 of the present embodiment is a work vehicle for loading the target object for loading onto the loading area LA as described above. The wheel loader 100 includes the vehicle body 110, the travel device 120 that causes the vehicle body 110 to travel, the lift arm 130 coupled to the vehicle body 110, and the bucket 140 coupled to the lift arm 130. Further, the wheel loader 100 includes the drive device 150 that actuates the lift arm 130 and the bucket 140, the area detection device 160 that detects the loading area LA, and the control device 170 connected to the travel device 120, the drive device 150, and the area detection device 160. The control device 170 recognizes the loading area LA on the basis of the detection result of the area detection device 160 and controls the travel device 120 and the drive device 150. In this manner, the control device 170 distributes the target object for loading contained in the bucket 140 to be loaded in a plurality of different positions of the loading area LA while changing the position of the vehicle body 110 in the front-back direction.

With such a configuration, the wheel loader 100 of the present embodiment can automatically distribute the target object for loading to be loaded in a plurality of different positions of the loading area LA in the front-back direction of the vehicle body 110. Thus, as shown in FIG. 4, for example, when the loading area LA is the loading platform of the dump truck 200, the target object for loading can be automatically evenly loaded in the front-back direction of the vehicle body 110 of the wheel loader 100 by means of the control device 170 without involving manual operation by the operator. Therefore, according to the wheel loader 100 of the present embodiment, the target object for loading can be evenly loaded onto the loading area LA, so that the burden on the operator can be mitigated. Further, for example, the target object for loading is evenly loaded onto the loading area LA of the target vehicle for loading, such as the loading platform of the dump truck 200, so that the operation performance of the target vehicle for loading is prevented from being adversely affected to thus be able to suppress abrasion of tires and deterioration of fuel.

Further, in the wheel loader 100 of the present embodiment, the control device 170 divides the loading area LA into the plurality of divided areas LA11 to LA33 in the front-back direction of the vehicle body 110. Then, the control device 170 controls the travel device 120 and the drive device 150 to thus distribute the target object for loading contained in the bucket 140 to be loaded onto the plurality of divided areas LA11 to LA33 while changing the position of the vehicle body 110 in the front-back direction. With such a configuration, the wheel loader 100 of the present embodiment can automatically distribute the target object for loading to be loaded onto the plurality of divided areas LA11 to LA33 of the loading area LA.

Further, the wheel loader 100 of the present embodiment further includes the loading quantity detection device 180 that detects the quantity of the target object for loading contained in the bucket 140. Furthermore, the control device 170 is connected to the loading quantity detection device 180, and loads the target object for loading contained in the bucket 140 in the plurality of different positions of the loading area LA while measuring the quantity of the target object for loading. With such a configuration, the wheel loader 100 of the present embodiment can load the target object for loading in an even quantity in the plurality of different positions of the loading area LA.

In addition, the wheel loader 100 of the present embodiment further includes the posture detection device 190 that detects the posture of the bucket 140. Furthermore, the control device 170 loads the target object for loading contained in the bucket 140 in the plurality of different positions of the loading area LA while measuring the posture of the bucket 140 on the basis of the detection result from the posture detection device 190. With such a configuration, the wheel loader 100 of the present embodiment can load the target object for loading in an even quantity in the plurality of different positions of the loading area LA while preventing the contact between the loading area LA and the bucket 140.

Further, in the wheel loader 100 of the present embodiment, the control device 170 controls the travel device 120 to dump the target object for loading contained in the bucket 140 to the plurality of different positions of the loading area LA while moving back the vehicle body 110 in such a manner as leaving away from the loading area LA.

With such a configuration, the wheel loader 100 of the present embodiment can more surely avoid the contact with the loading area LA. More specifically, for example, the target object for loading can be first loaded onto the divided areas LA11, LA21, LA31 of the loading area LA that are positioned at the forefront in the front-back direction of the vehicle body 110. Therefore, computation for avoiding the contact between the loading area LA and the bucket 140 is first performed, so that the computation result can be used in loading the target object for loading onto the divided areas LA12 to LA32 and LA13 to LA33 in the rear.

Further, in the wheel loader 100 of the present embodiment, the area detection device 160 is attached to the upper portion of the operating room 112 provided in the vehicle body 110. With such a configuration, blind spots of the area detection device 160 are reduced, so that the loading area LA can be more surely detected.

As described above, according to the present embodiment, the wheel loader 100 can be provided that is capable of evenly loading the target object for loading onto the loading area LA so that the burden on the operator can be mitigated. Note that the wheel loader of the present disclosure is not limited to the above-described configuration.

Hereinafter, some modifications of the wheel loader 100 according to the present embodiment will be described.

In the above-described embodiment, the case in which the area detection device 160 of the wheel loader 100 is an image capturing device or a laser radar. However, as shown in FIG. 4, for example, when the dump truck 200 includes a position detection section 210, such as a receiver of the GNSS, and a communication device 220, the area detection device 160 may be a communication device that can communicate with the communication device 220 of the dump truck 200 and may include a position detection device 161 such as a receiver of the GNSS. In this case, the loading area LA is the loading platform of the dump truck 200 including the communication device 220 and the area detection device 160 of the wheel loader 100 acquires the shape, the size, and the position of the loading platform transmitted from the communication device 220 of the dump truck 200 and detects the loading area LA. Further, the loading area recognition section 171 of the control device 170 recognizes the loading area LA on the basis of the detection result from the area detection device 160 and the detection result from the position detection device 161. With such a configuration, the same effects as those of the wheel loader 100 described in the above-described embodiment can be produced, and also the computation of the position and the shape of the loading area LA is omitted so that the processing load on the control device 170 can be mitigated.

Further, in the wheel loader 100 according to the above-described embodiment, the input device 112*b* shown in FIG. 2 may be omitted. In this case, the number of divisions N of the loading area LA in the front-back direction of the vehicle body 110 can be calculated by the control device 170. More specifically, for example, the control device 170 divides the loading area LA into a plurality of loading rows in the width direction of the vehicle body 110 of the wheel loader 100 on the basis of the size of the loading area LA and the size of the bucket 140, by means of the loading computing section 172. In this manner, the loading area LA is divided into a plurality of areas in the width direction of the vehicle body 110, such as the first loading row LA1, the second loading row LA2, and the third loading row LA3 that are shown in FIG. 4, for example. Further, similarly to the above-described embodiment, the control device 170 controls the travel device 120 and the drive device 150 so that the target object for loading contained in the bucket 140 is distributed to be loaded onto, for example, the plurality of divided areas LA11 to LA33 in one of the loading rows, which is the first loading row LA1, the second loading row LA2, or the third loading row LA3, while changing the position of the vehicle body 110 in the front-back direction. With such a configuration, the number of divisions N can be automatically calculated without inputting the number of divisions N of the loading area LA to the input device 112*b*.

Further, in the wheel loader 100, the control device 170 may calculate the number of divisions of the loading area LA on the basis of the maximum loading quantity of the target object for loading in the loading area LA and the maximum loading quantity of the target object for loading in the bucket 140. In this manner, for example, the control device 170 automatically calculates, by means of the loading computing section 172, the number of times of loading the target object for loading onto the loading area LA by means of the bucket 140 to thus be able to calculate the plurality of loading rows such as the first loading row LA1, the second loading row LA2, and the loading row LA3. Furthermore, it is possible to automatically calculate the number of divisions in the front-back direction of the vehicle body 110, such as the divided areas LA11 to LA13 in each loading row.

The embodiment of the wheel loader according to the present disclosure has been described in detail using the drawings, but the specific configuration is not limited to the embodiment, and design changes or the like within the scope without departing the gist of the present disclosure are included in the present disclosure.

REFERENCE SIGNS LIST

100 wheel loader
110 vehicle body
112 operating room
120 travel device
130 lift arm
140 bucket
150 drive device
160 area detection device
170 control device
180 loading quantity detection device
190 posture detection device
LA loading area
200 dump truck
220 communication device
LA1 to LA3 loading row
LA11 to LA33 divided area

The invention claimed is:

1. A wheel loader comprising:

a vehicle body;

a lift arm provided in the vehicle body so as to be vertically rotatable;

a bucket provided on a tip end side of the lift arm so as to be able to perform dumping or tilting operation;

a drive unit that is provided in the vehicle body and that drives wheels;

a hydraulic actuator including a lift arm cylinder that actuates the lift arm and a bucket cylinder that actuates the bucket;

a pressure sensor that detects a pressure of the hydraulic actuator;

a posture sensor that detects a posture of the bucket;

an external environment recognition sensor that recognizes a target vehicle for loading; and a controller that controls the hydraulic actuator and the drive unit, wherein the controller includes:

a load computing section that computes a load of a target object loaded in the bucket, on the basis of the pressure detected by the pressure sensor;

a loading platform recognition section that recognizes a loading platform of the target vehicle for loading that is detected by the external environment recognition sensor;

a loading position computing section that computes loading sections such that the target object loaded in the bucket is evenly loaded onto the loading platform by sectioning, into a plurality of sections in a traveling direction of the vehicle body, the loading platform of the target vehicle for loading that is recognized by the loading platform recognition section;

a bucket control section that controls a loading quantity for each of the sections such that the target object with a weight equal to the load of the target object divided by a number of sections of the loading platform is loaded for each of the sections on the basis of the load of the target object computed by the load computing section and the sections of the loading platform computed by the loading position computing section; and a travel control section that controls the drive unit to, when loading the target object to each of the sections of the loading platform is completed, cause the vehicle body to move a distance corresponding to a length of each of the sections of the loading platform on the basis of the sections of the loading platform computed by the loading position computing section.

2. The wheel loader according to claim 1, wherein the external environment recognition sensor is a camera that recognizes an external environment.

3. The wheel loader according to claim 1, wherein the external environment recognition sensor is disposed in an upper portion of an operating room provided in the vehicle body.

4. The wheel loader according to claim 1, wherein the external environment recognition sensor recognizes a position and a shape of the loading platform of the target vehicle for loading by communicating with the target vehicle for loading so that a relative position between the target vehicle for loading and the vehicle body is computed.

5. The wheel loader according to claim 1, wherein the controller controls the bucket while controlling the drive unit in a direction in which the vehicle body moves back, on the basis of the load of the target object computed by the load computing section and a position of the loading platform computed by the loading position computing section, after the vehicle body approaches closest to the target vehicle for loading.

* * * * *